US007619637B2

(12) United States Patent
Higgins et al.

(10) Patent No.: US 7,619,637 B2
(45) Date of Patent: Nov. 17, 2009

(54) SYSTEMS AND METHODS FOR IMPROVED GAMUT MAPPING FROM ONE IMAGE DATA SET TO ANOTHER

(75) Inventors: Michael Francis Higgins, Duncan Mills, CA (US); Candice Hellen Brown Elliott, Vallejo, CA (US)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 618 days.

(21) Appl. No.: 10/821,306

(22) Filed: Apr. 9, 2004

(65) Prior Publication Data

US 2005/0225562 A1 Oct. 13, 2005

(51) Int. Cl.
*G09G 5/02* (2006.01)
*G09G 5/04* (2006.01)

(52) U.S. Cl. ..... 345/604; 358/1.9; 358/1.12; 345/88; 345/589; 382/162; 382/167

(58) Field of Classification Search ..... 345/604, 345/88, 589; 358/1.12; 382/162, 167
See application file for complete search history.

(56) References Cited

U.S. PATENT DOCUMENTS 4,439,759 A 3/1984 Fleming et al.
4,751,535 A 6/1988 Myers
4,946,259 A 8/1990 Matino et al.
4,989,079 A 1/1991 Ito
5,233,385 A 8/1993 Sampsell
5,311,295 A * 5/1994 Tallman et al. ..... 348/180
5,341,153 A 8/1994 Benzschawel et al.
5,398,066 A 3/1995 Martinez-Uriegas et al.
5,416,890 A 5/1995 Beretta
5,438,649 A 8/1995 Ruetz
5,448,652 A 9/1995 Vaidyanathan et al.
5,450,216 A 9/1995 Kasson
5,459,595 A 10/1995 Ishiguro
5,668,890 A * 9/1997 Winkelman ..... 382/167
5,694,186 A 12/1997 Yanagawa et al.
5,719,639 A 2/1998 Imamura
5,724,442 A 3/1998 Ogatsu et al.
5,731,818 A 3/1998 Wan et al.
5,821,913 A 10/1998 Mamiya
5,917,556 A 6/1999 Katayama (Continued)

FOREIGN PATENT DOCUMENTS

GB 2 282 928 A 4/1995

(Continued)

OTHER PUBLICATIONS

Morovic, J., Gamut Mapping, in Digital Color Imaging Handbook, ed. G. Sharma, Boca Raton, FL: CRC Press, Dec. 2002, Chapter 10, pp. 635-682.

(Continued)

*Primary Examiner*—King Y Poon
*Assistant Examiner*—Quang N Vo
(74) *Attorney, Agent, or Firm*—Innovation Counsel LLP

(57) ABSTRACT

The present application discloses methods and system for converting input image data in a first color space into image data in a second color space format. Several embodiments disclose improved techniques for performing these conversions using inexpensive hardware and software implementations.

10 Claims, 7 Drawing Sheets

U.S. PATENT DOCUMENTS

| | | | | |
|---|---|---|---|---|
| 5,929,843 | A | 7/1999 | Tanioka | |
| 5,933,253 | A | 8/1999 | Ito et al. | |
| 5,937,089 | A * | 8/1999 | Kobayashi | 382/167 |
| 5,949,496 | A | 9/1999 | Kim | |
| 5,963,263 | A | 10/1999 | Shyu | |
| 5,987,165 | A | 11/1999 | Matsuzaki et al. | |
| 5,990,997 | A | 11/1999 | Jones et al. | |
| 6,005,968 | A * | 12/1999 | Granger | 382/162 |
| 6,023,527 | A | 2/2000 | Narahara | |
| 6,054,832 | A | 4/2000 | Kunzman et al. | |
| 6,097,367 | A | 8/2000 | Kuriwaki et al. | |
| 6,108,053 | A | 8/2000 | Pettitt et al. | |
| 6,137,560 | A | 10/2000 | Utsumi et al. | |
| 6,147,664 | A | 11/2000 | Hansen | |
| 6,256,425 | B1 | 7/2001 | Kunzman | |
| 6,262,710 | B1 | 7/2001 | Smith | |
| 6,278,434 | B1 | 8/2001 | Hill et al. | |
| 6,297,826 | B1 | 10/2001 | Semba et al. | |
| 6,360,008 | B1 | 3/2002 | Suzuki et al. | |
| 6,360,023 | B1 | 3/2002 | Betrisey et al. | |
| 6,384,836 | B1 | 5/2002 | Naylor, Jr. et al. | |
| 6,393,145 | B2 | 5/2002 | Betrisey et al. | |
| 6,421,142 | B1 | 7/2002 | Lin et al. | |
| 6,453,067 | B1 | 9/2002 | Morgan et al. | |
| 6,459,419 | B1 | 10/2002 | Matsubayashi | |
| 6,483,518 | B1 | 11/2002 | Perry et al. | |
| 6,536,904 | B2 | 3/2003 | Kunzman | |
| 6,614,414 | B2 | 9/2003 | De Haan et al. | |
| 6,633,302 | B1 | 10/2003 | Ohsawa et al. | |
| 6,707,463 | B1 | 3/2004 | Gibson et al. | |
| 6,724,934 | B1 | 4/2004 | Lee et al. | |
| 6,738,526 | B1 | 5/2004 | Betrisey et al. | |
| 6,750,874 | B1 | 6/2004 | Kim | |
| 6,870,523 | B1 | 3/2005 | Ben-David et al. | |
| 6,885,380 | B1 * | 4/2005 | Primerano et al. | 345/589 |
| 6,937,217 | B2 | 8/2005 | Klompenhouwer et al. | |
| 6,980,219 | B2 | 12/2005 | Higgins | |
| 7,027,105 | B2 | 4/2006 | Lee et al. | |
| 7,176,935 | B2 | 2/2007 | Higgins | |
| 7,184,067 | B2 | 2/2007 | Miller et al. | |
| 7,301,543 | B2 | 11/2007 | Higgins | |
| 2001/0048764 | A1 | 12/2001 | Betrisey et al. | |
| 2002/0063670 | A1 | 5/2002 | Yoshinaga et al. | |
| 2003/0058466 | A1 | 3/2003 | Hoshuyama | |
| 2003/0112454 | A1 | 6/2003 | Woolfe et al. | |
| 2003/0117457 | A1 | 6/2003 | Qiao | |
| 2003/0128872 | A1 | 7/2003 | Lee et al. | |
| 2003/0151694 | A1 | 8/2003 | Lee et al. | |
| 2003/0179212 | A1 | 9/2003 | Matsushiro et al. | |
| 2003/0214499 | A1 | 11/2003 | Ohsawa et al. | |
| 2004/0021804 | A1 | 2/2004 | Hong et al. | |
| 2004/0046725 | A1 * | 3/2004 | Lee | 345/88 |
| 2004/0095521 | A1 | 5/2004 | Song et al. | |
| 2004/0111435 | A1 | 6/2004 | Herbert et al. | |
| 2004/0114046 | A1 | 6/2004 | Lee et al. | |
| 2004/0222999 | A1 | 11/2004 | Choi et al. | |
| 2004/0239813 | A1 | 12/2004 | Klompenhouwer | |
| 2005/0024734 | A1 | 2/2005 | Richards et al. | |
| 2005/0031199 | A1 * | 2/2005 | Ben-Chorin et al. | 382/162 |
| 2005/0083341 | A1 | 4/2005 | Higgins et al. | |
| 2005/0083344 | A1 | 4/2005 | Higgins | |
| 2005/0083345 | A1 | 4/2005 | Higgins | |
| 2005/0083352 | A1 | 4/2005 | Higgins | |
| 2005/0094871 | A1 | 5/2005 | Berns et al. | |
| 2005/0105147 | A1 | 5/2005 | Gruzdev et al. | |
| 2005/0152597 | A1 | 7/2005 | Spaulding et al. | |
| 2005/0212728 | A1 | 9/2005 | Miller et al. | |
| 2005/0219274 | A1 | 10/2005 | Yang et al. | |
| 2005/0225561 | A1 | 10/2005 | Higgins et al. | |
| 2005/0225562 | A1 | 10/2005 | Higgins et al. | |
| 2005/0264580 | A1 | 12/2005 | Higgins | |
| 2006/0244686 | A1 | 11/2006 | Higgins et al. | |

FOREIGN PATENT DOCUMENTS

| | | | |
|---|---|---|---|
| JP | 6-261332 | | 9/1994 |
| JP | 08-202317 | | 8/1996 |
| WO | WO 00/42762 | | 7/2000 |
| WO | WO 01/37251 | A1 | 5/2001 |
| WO | WO 2004/040548 | | 5/2004 |
| WO | WO 2004/086128 | A1 | 10/2004 |
| WO | WO 2005/050296 | A1 | 6/2005 |
| WO | WO 2005/076257 | A2 | 8/2005 |

OTHER PUBLICATIONS

Murch, M., "Visual Perception Basics," SID Seminar, 1987, Tektronix Inc, Beaverton Oregon.

PCT International Search Report dated May 21, 2007 for PCT/US04/33709 (U.S. Appl. No. 10/691,396).

PCT International Search Report dated Apr. 26, 2005 for PCT/US04/33743 (U.S. Patent No. 7,176,935).

Wandell, Brian A., Stanford University, "Fundamentals of Vision: Behavior . . . ," Jun. 12, 1994, Society for Information Display (SID) Short Course S-2, Fairmont Hotel, San Jose, California.

Werner, Ken, "OLEDS, OLEDS, Everywhere . . . ," Information Display, Sep. 2002, pp. 12-15.

USPTO, Notice of Allowance, dated Mar. 21, 2005 in U.S. Patent No. 6,980,219 (U.S. Appl. No. 10,691,200).

USPTO, Non-Final Office Action dated Jul. 20, 2007 in U.S. Patent Publication No. 2005/0264580 (U.S. Appl. No. 11/196,631).

Clairvoyante, Inc, Response to Non-Final Office Action dated Jan. 22, 2008 in U.S. Patent Publication No. 2005/0264580 (U.S. Appl. No. 11/196,631).

USPTO, Non-Final Office Action dated Dec. 7, 2007 in U.S. Patent Publication No. 2005/0083341 (U.S. Appl. No. 10/691,377).

USPTO, Non-Final Office Action dated Jul. 27, 2006 in U.S. Patent Publication No. 2005/0083352 (U.S. Appl. No. 10/691,396).

Clairvoyante, Inc. Response to Non-Final Office Action, dated Dec. 20, 2006 in U.S. Patent Publication No. 2005/0083352 (U.S. Appl. No. 10/691,396).

USPTO, Non-Final Office Action dated Mar. 6, 2007 in U.S. Patent Publication No. 2005/0083352 (U.S. Appl. No. 10/691,396).

Clairvoyante, Inc. Response to Non-Final Office Action, dated Jul. 6, 2007 in U.S. Patent Publication No. 2005/0083352.

USPTO, Non-Final Office Action dated Sep. 20, 2007 in U.S. Patent Publication No. 2005/0083352 (U.S. Appl. No. 10/691,396).

Clairvoyante, Inc. Response to Non-Final Office Action, dated Mar. 20, 2008 in U.S. Patent Publication No. 2005/0083352 (U.S. Appl. No. 10/691,396).

USPTO, Non-Final Office Action dated Jun. 13, 2005 in U.S. Patent No. 7,176,935 (U.S. Appl. No. 10/690,716).

Clairvoyante, Inc. Response to Non-Final Office Action, dated Dec. 13, 2005 in U.S. Patent No. 7,176,935 (U.S. Appl. No. 10/690,716).

Clairvoyante, Inc., Supplemental Amendment dated Aug. 23, 2006 in U.S. Patent No. 7,176,935 (U.S. Appl. No. 10/690,716).

USPTO, Interview Summary, dated Aug. 25, 2006 in U.S. Patent No. 7,176,935 (U.S. Appl. No. 10/690,716).

USPTO, Interview Summary, dated Aug. 29, 2006 in U.S. Patent No. 7,176,935 (U.S. Appl. No. 10/690,716).

USPTO, Notice of Allowance, dated Jul. 27, 2007 in U.S. Patent No. 7,301,543 (U.S. Appl. No. 10/821,386).

MacPherson-Kwok Inc, Response to Non-Final Office Action dated Apr. 17, 2008 in U.S. Patent Publication No. 2005/0264580 (U.S. Appl. No. 11/196,631).

USPTO, Final Office Action dated May 9, 2008 in U.S. Patent Publication No. 2005/0264580 (U.S. Appl. No. 11/196,631).

MacPherson-Kwok Inc, Response to Final Office Action dated Jul. 8, 2008 in U.S. Patent Publication No. 2005/0264580 (U.S. Appl. No. 11/196,631).

MacPherson-Kwok Inc, Response to Non-Final Office Action dated May 7, 2008 in U.S. Patent Publication No. 2005/0083341 (U.S. Appl. No. 10/691,377).

USPTO, Final Office Action dated Jun. 27, 2008 in U.S. Patent Publication No. 2005/0083352 (U.S. Appl. No. 10/691,396).

USPTO, Non-Final Office Action dated Jul. 9, 2008 in U.S. Patent Publication No. 2004/0244686 (U.S. Appl. No. 11/278,675).
U.S. Appl. No. 11/196,631, Zimmerman, M, Awaiting First OA.
U.S. Appl. No. 10/691,377, Moore, D, Awaiting First OA.
U.S. Appl. No. 10/691,396, Amin, J, Non-Final OA mailed.
U.S. Appl. No. 10/690,716, Luu, M, Notice of Allowance Mailed.
U.S. Appl. No. 10/821,386, Hjerpe, R, Awaiting First OA.
U.S. Appl. No. 11/278,675, TBD, Awaiting First OA.
Betrisey, C., et al., Displaced Filtering for Patterned Displays, SID Symp. Digest 1999, pp. 296-299.
Brown Elliott C., "Active Matrix Display . . . ", IDMC 2000, 185-189, Aug. 2000.
Brown Elliott, C., "Color Subpixel Rendering Projectors and Flat Panel Displays," SMPTE, Feb. 27-Mar. 1, 2003, Seattle, WA pp. 1-4.
Brown Elliott, C, "Co-Optimization of Color AMLCD Subpixel Architecture and Rendering Algorithms," SID 2002 Proceedings Paper, May 30, 2002 pp. 172-175.
Brown Elliott, C, "Development of the PenTile Matrix™ Color AMLCD Subpixel Architecture and Rendering Algorithms", SID 2003, Journal Article.
Brown Elliott, C, "New Pixel Layout for PenTile Matrix™ Architecture", IDMC 2002, pp. 115-117.
Brown Elliott, C, "Reducing Pixel Count Without Reducing Image Quality", Information Display Dec. 1999, vol. 1, pp. 22-25.
Credelle, Thomas, "P-00: MTF of High-Resolution PenTile Matrix Displays", Eurodisplay 02 Digest, 2002 pp. 1-4.
Klompenhouwer, Michiel, Subpixel Image Scaling for Color Matrix Displays, SID Syrnp. Digest, May 2002, pp. 176-179.
Michiel A. Klompenhouwer, Gerard de Haan, Subpixel image scaling for color matrix displays, Journal of the Society for Information Display, vol. 11, Issue 1, Mar. 2003, pp. 99-108.
Messing, Dean et al., Improved Display Resolution of Subsampled Colour Images Using Subpixel Addressing, IEEE ICIP 2002, vol. 1, pp. 625-628.
Messing, Dean et al., Subpixel Rendering on Non-Striped Colour Matrix Displays, 2003 International Conf on Image Processing, Sep. 2003, Barcelona, Spain, 4 pages.

* cited by examiner

SYSTEMS AND METHODS FOR IMPROVED GAMUT MAPPING FROM ONE IMAGE DATA SET TO ANOTHER

BACKGROUND

In commonly owned U.S. patent applications: (1) U.S. patent application Ser. No. 09/916,232 ("the '232 application"), entitled "ARRANGEMENT OF COLOR PIXELS FOR FULL COLOR IMAGING DEVICES WITH SIMPLIFIED ADDRESSING," filed Jul. 25, 2001; (2) U.S. patent application Ser. No. 10/278,353 ("the '353 application"), entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) U.S. patent application Ser. No. 10/278,352 ("the '352 application"), entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) U.S. patent application Ser. No. 10/243,094 ("the '094 application), entitled "IMPROVED FOUR COLOR ARRANGEMENTS AND EMITTERS FOR SUB-PIXEL RENDERING," filed Sep. 13, 2002; (5) U.S. patent application Ser. No. 10/278,328 ("the '328 application"), entitled "IMPROVEMENTS TO COLOR FLAT PANEL DISPLAY SUB-PLXEL ARRANGEMENTS AND LAYOUTS WITH REDUCED BLUE LUMINANCE WELL VISIBILITY," filed Oct. 22, 2002; (6) U.S. patent application Ser. No. 10/278,393 ("the '393 application"), entitled "COLOR DISPLAY HAVING HORIZONTAL SUB-PIXEL ARRANGEMENTS AND LAYOUTS," filed Oct. 22, 2002; (7) U.S. patent application Ser. No. 01/347,001 ("the '001 application") entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003, each of which is herein incorporated by reference in its entirety, novel sub-pixel arrangements are disclosed for improving the cost/performance curves for image display devices.

For certain subpixel repeating groups having an even number of subpixels in a horizontal direction, the following systems and techniques to affect improvements, e.g. proper dot inversion schemes and other improvements, are disclosed and are herein incorporated by reference in their entirety: (1) U.S. patent application Ser. No. 10/456,839 entitled "IMAGE DEGRADATION CORRECTION IN NOVEL LIQUID CRYSTAL DISPLAYS"; (2) U.S. patent application Ser. No. 10/455,925 entitled "DISPLAY PANEL HAVING CROSS-OVER CONNECTIONS EFFECTING DOT INVERSION"; (3) U.S. patent application Ser. No. 10/455,931 entitled "SYSTEM AND METHOD OF PERFORMING DOT INVERSION WITH STANDARD DRIVERS AND BACKPLANE ON NOVEL DISPLAY PANEL LAYOUTS"; (4) U.S. patent application Ser. No. 10/455,927 entitled "SYSTEM AND METHOD FOR COMPENSATING FOR VISUAL EFFECTS UPON PANELS HAVING FIXED PATTERN NOISE WITH REDUCED QUANTIZATION ERROR"; (5) U.S. patent application Ser. No. 10/456,806 entitled "DOT INVERSION ON NOVEL DISPLAY PANEL LAYOUTS WITH EXTRA DRIVERS"; (6) U.S. patent application Ser. No. 10/456,838 entitled "LIQUID CRYSTAL DISPLAY BACKPLANE LAYOUTS AND ADDRESSING FOR NON-STANDARD SUBPIXEL ARRANGEMENTS"; (7) U.S. patent application Ser. No. 10/696,236 entitled "IMAGE DEGRADATION CORRECTION IN NOVEL LIQUID CRYSTAL DISPLAYS WITH SPLIT BLUE SUBPIXELS", filed Oct. 28, 2003; and (8) U.S. patent application Ser. No. 10/807,604 entitled "IMPROVED TRANSISTOR BACKPLANES FOR LIQUID CRYSTAL DISPLAYS COMPRISING DIFFERENT SIZED SUBPIXELS", filed Mar. 23, 2004.

These improvements are particularly pronounced when coupled with sub-pixel rendering (SPR) systems and methods further disclosed in those applications and in commonly owned U.S. patent applications: (1) U.S. patent application Ser. No. 10/051,612 ("the '612 application"), entitled "CONVERSION OF RGB PIXEL FORMAT DATA TO PENTILE MATRIX SUB-PIXEL DATA FORMAT," filed Jan. 16, 2002; (2) U.S. patent application Ser. No. 10/150,355 ("the '355 application"), entitled "METHODS AND SYSTEMS FOR SUB-PIXEL RENDERING WITH GAMMA ADJUSTMENT," filed May 17, 2002; (3) U.S. patent application Ser. No. 10/215,843 ("the '843 application"), entitled "METHODS AND SYSTEMS FOR SUB-PIXEL RENDERING WITH ADAPTIVE FILTERING," filed Aug. 8, 2002; (4) U.S. patent application Ser. No. 10/379,767 entitled "SYSTEMS AND METHODS FOR TEMPORAL SUB-PIXEL RENDERING OF IMAGE DATA" filed Mar. 4, 2003; (5) U.S. patent application Ser. No. 10/379,765 entitled "SYSTEMS AND METHODS FOR MOTION ADAPTIVE FILTERING," filed Mar. 4, 2003; (6) U.S. patent application Ser. No. 10/379,766 entitled "SUB-PIXEL RENDERING SYSTEM AND METHOD FOR IMPROVED DISPLAY VIEWING ANGLES" filed Mar. 4, 2003; (7) U.S. patent application Ser. No. 10/409,413 entitled "IMAGE DATA SET WITH EMBEDDED PRE-SUBPIXEL RENDERED IMAGE" filed Apr. 7, 2003, which are hereby incorporated herein by reference in their entirety.

Improvements in gamut conversion and mapping are disclosed in commonly owned and co-pending U.S. patent applications: (1) U.S. patent application Ser. No. 10/691,200 entitled "HUE ANGLE CALCULATION SYSTEM AND METHODS", filed Oct. 21, 2003; (2) U.S. patent application Ser. No. 10/691,377 entitled "METHOD AND APPARATUS FOR CONVERTING FROM SOURCE COLOR SPACE TO RGBW TARGET COLOR SPACE", filed Oct. 21, 2003; (3) U.S. patent application Ser. No. 10/691,396 entitled "METHOD AND APPARATUS FOR CONVERTING FROM A SOURCE COLOR SPACE TO A TARGET COLOR SPACE", filed Oct. 21, 2003; and (4) U.S. patent application Ser. No. 10/690,716 entitled "GAMUT CONVERSION SYSTEM AND METHODS" filed Oct. 21, 2003 which are all hereby incorporated herein by reference in their entirety.

Additional advantages have been described in (1) U.S. patent application Ser. No. 10/696,235 entitled "DISPLAY SYSTEM HAVING IMPROVED MULTIPLE MODES FOR DISPLAYING IMAGE DATA FROM MULTIPLE INPUT SOURCE FORMATS", filed Oct. 28, 2003 and (2) U.S. patent application Ser. No. 10/696,026 entitled "SYSTEM AND METHOD FOR PERFORMING IMAGE RECONSTRUCTION AND SUBPIXEL RENDERING TO EFFECT SCALING FOR MULTI-MODE DISPLAY" filed Oct. 28, 2003.

Additionally, these co-owned and co-pending applications are herein incorporated by reference in their entirety: (1) U.S. patent application Serial No. 10/821,387 entitled "SYSTEM AND METHOD FOR IMPROVING SUB-PIXEL RENDERING OF IMAGE DATA IN NON-STRIPED DISPLAY SYSTEMS"; (2) U.S. patent application Ser. No. 10/821,386 entitled "SYSTEMS AND METHODS FOR SELECTING A WHITE POINT FOR IMAGE DISPLAYS"; (3) U.S. patent application Ser. No. 10/821,353 entitled "NOVEL SUBPIXEL LAYOUTS AND ARRANGEMENTS FOR HIGH BRIGHTNESS DISPLAYS"; (4) U.S. patent application Ser. No. 10/821,388 entitled "IMPROVED SUBPIXEL RENDERING FILTERS FOR HIGH BRIGHTNESS SUBPIXEL LAYOUTS"; which are all hereby incorporated by reference. All patent applications mentioned in this specification are hereby incorporated by reference in their entirety.

BRIEF DESCRIPTION OF THE DRAWINGS

The accompanying drawings, which are incorporated in, and constitute a part of this specification illustrate exemplary implementations and embodiments of the invention and, together with the description, serve to explain principles of the invention.

DETAILED DESCRIPTION

Reference will now be made in detail to implementations and embodiments, examples of which are illustrated in the accompanying drawings. Wherever possible, the same reference numbers will be used throughout the drawings to refer to the same or like parts.

Architecture Overview

Several systems and methods for gamut mapping from one color space to another were disclosed in the above incorporated '200, '377, '396 and the '716 applications. The present application improves upon those systems and methods by disclosing additional savings, efficiencies and cost reduction in both the hardware and the software implementations of those systems.

One potential simplifying assumption that may lead to efficiencies is assuming that the target color space is RGBW. Given that assumption, there are many optimizations possible in the "gamut pipeline". For example, for a RGB to RGBW gamut mapping system, gamut expansion may not be very important or applicable; but gamut clamping might be desired after gamut conversion. Additionally, for multiprimary systems (e.g. RGBC or the like) that employ the 3×4 matrix multiply normally required for 4-primary multi-primary can be replaced by a 3×3 matrix multiplier and a MUX. Also, those 3×3 matrices, according to disclosed methods here and in application mentioned above, may have many elements that are zeros, ones, and/or powers of two. Such conditions may allow special purpose hardware to do the matrix multiplies with a reduced number of gates.

Figure 1:
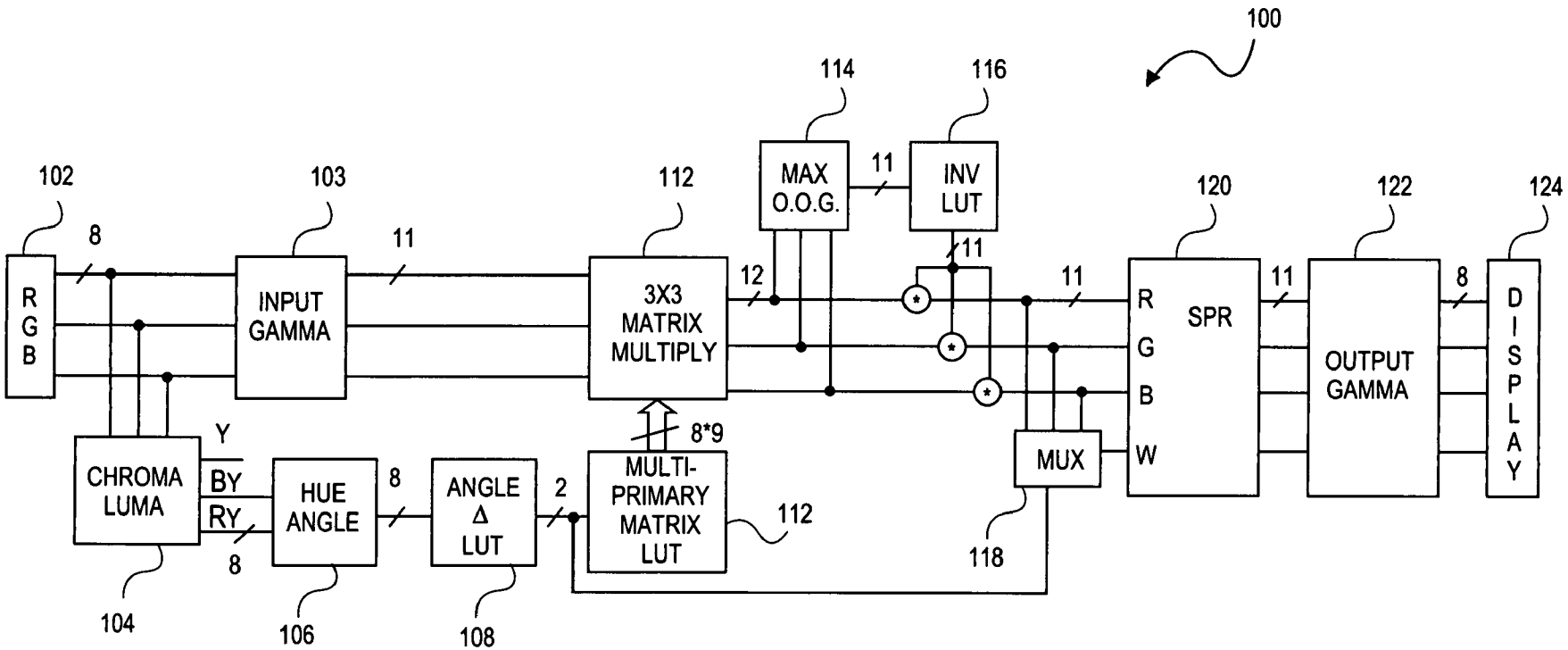
FIG. 1 is an overview of one embodiment of an architecture of an RGB to RGBW converter.

FIG. 1 shows one possible gamut mapping system 100 from a RGB color space to a RGBW color space. RGB data input 102 (possibly 8 bits per color) is input into a chroma/luma converter 104. The output of block 104 could be one of a number of chrominance/luminance coordinates (e.g. Y, By, Ry or the like) and input into a hue angle calculator 106 which then could be passed to a hue angle triangle look-up table 108 (as previously described in the above incorporated applications). The hue angle triangle could then be converted into a multi-primary matrix look-up table 110 which loads matrix coefficients into 3×3 matrix multiply 112. It will be appreciated that the specification of the number of bits per line—in either the specification or the accompanying figures—are offered only to elucidate possible embodiment; but that the scope of the present invention is not limited to any particular data set or specified bandwidth on any data path.

Chroma Luma Converter

The "NTSC" formula for calculating luminosity is:

$Y=0.2126*R+0.7152*G+0.0511*B$. However, for the purposes of calculating hue angle, the formula $Y=(2*R+5*G+B)/8$ may suffice as close enough and it can be advantageously calculated using only binary shifts and adds. This is equivalent to calculating $Y=0.25*R+0.625*G+0.125*B$.

Figure 2:
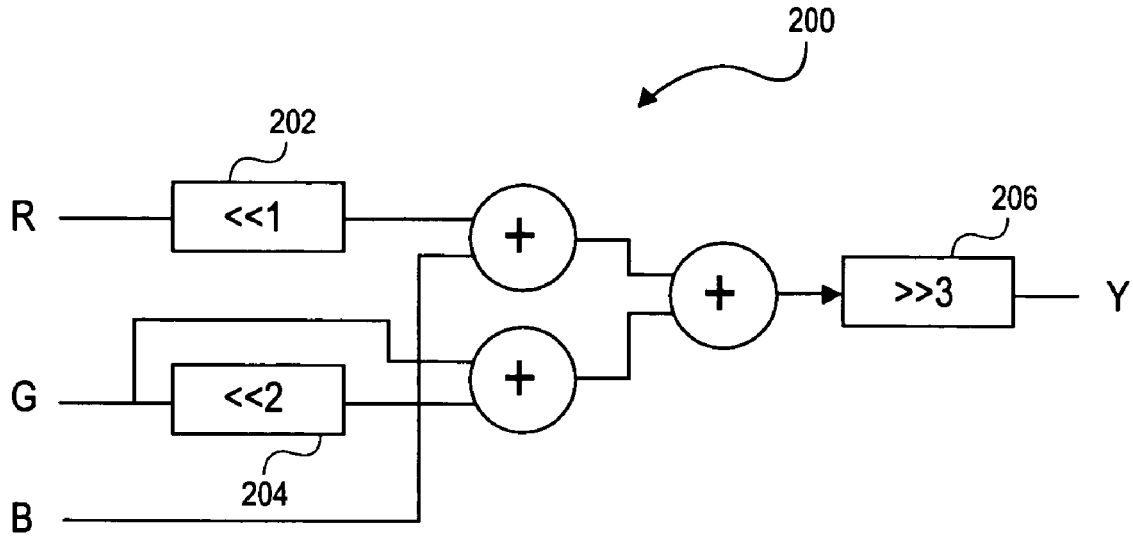
FIG. 2 is an embodiment of a simplified RGB to luminosity converter.

FIG. 2 shows one embodiment of a high level block diagram 200 that implements Y calculation as above. RGB data is input and the R is left shifted by 1 bit (i.e. multiply by 2) at 202, G data is left shifted 2 bits and added to itself (i.e. multiply by 5) at 204 and B data is added to the red which is then summed with the green total. The resulting sum is then right shifted by 3 bits at 206 to supply the final Y data as given above. It should be appreciated that the operation and their orders may be changed, as long as the arithmetic result is the same.

Figure 3:
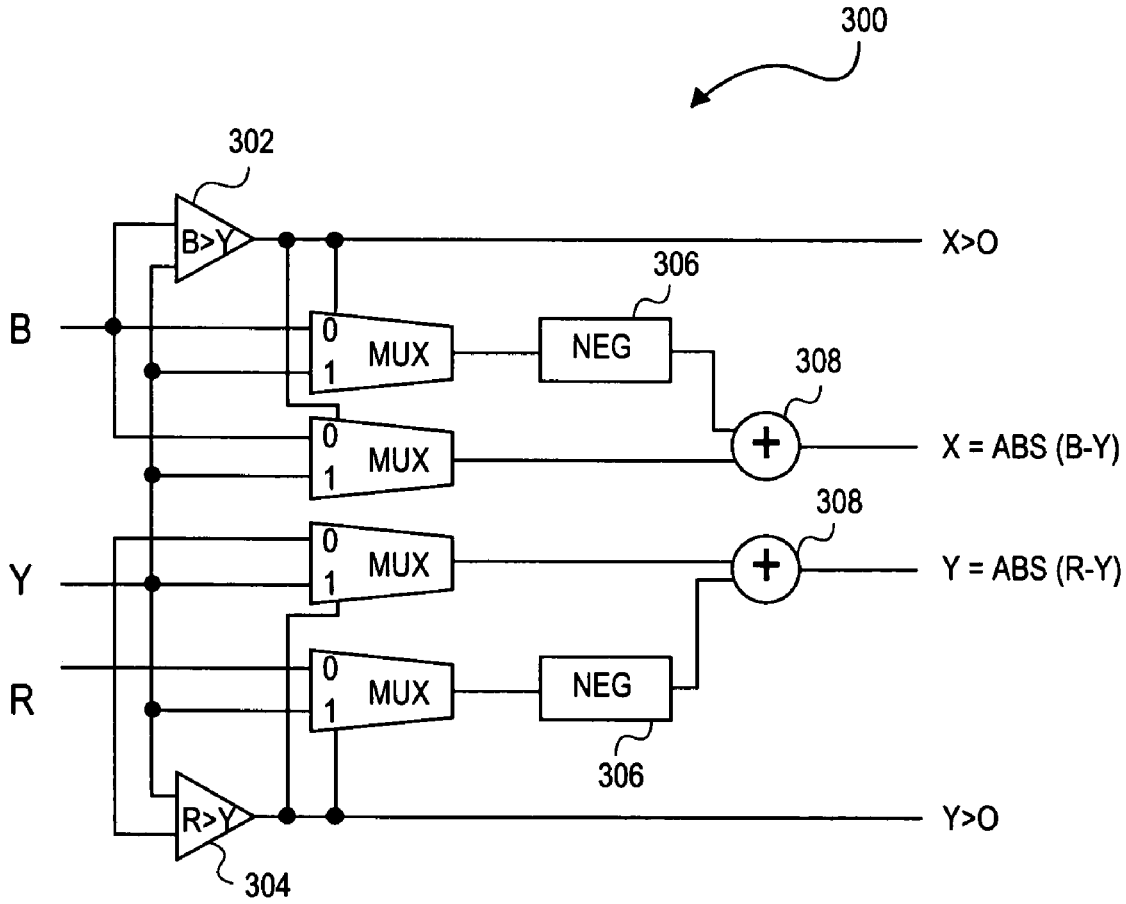
FIG. 3 is an embodiment of an simplified RGB to chrominance converter.

FIG. 3 shows one embodiment of a chroma calculating block 300. The chroma component is a vector, two signed numbers, calculated from the formulae $x=B-Y$ and $y=R-Y$. However, it may be desirable to use the absolute value of these numbers, so it is possible to calculate their absolute values directly and keep the signs separate. Comparators 302 and 304 are used to determine if $B>Y$ and if $R>Y$, respectively. The results of these are saved as the signs of x and y for the hue angle calculator and also used to selectively swap the values before subtracting them. Subtraction may be accomplished as a twos compliment NEG operation 306 followed by an addition 308. As the values input are signed numbers, the NEG operation may result in an additional bit. However, this bit may be ignored in the addition since the sign is known to be one and the result is known to be a positive number. Alternatively, this functionality could be accomplished in a number of different ways, including to perform all possible subtractions for both values and select the positive ones at the end.

Hue Angle Calculator

Figure 4:
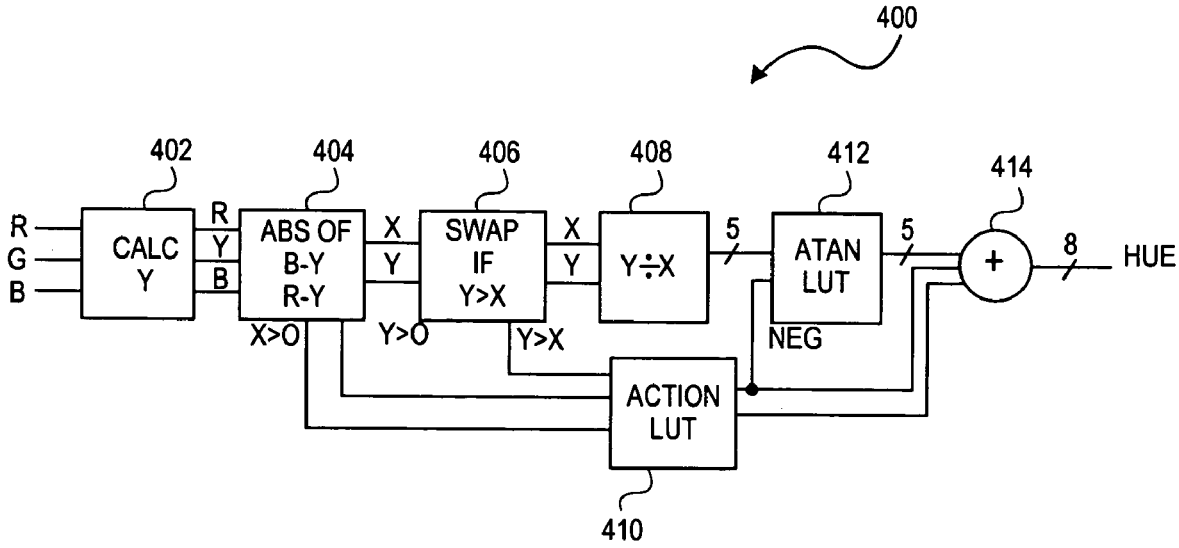
FIG. 4 is an embodiment of a hue angle calculator.

It may be possible to combine the chroma/luma converter with the hue angle calculator and achieve certain optimizations. FIG. 4 depicts one embodiment of such a combined hue angle calculator 400.

Absolute Value of Chroma

If the chroma/luma converter is combined with the hue angle calculator (as in blocks 402 and 404), the absolute values of the chroma are already available, including the signs as they would have been before taking the absolute values. Taking the absolute value helps to limit calculations to one quadrant of the possible color vector angles. It will be appreciated that the "Y" in blocks 402 and 404 refer to the luminance value; while "y" output from block 404 onward refers to a chrominance value.

Select Octant, y>x

Figure 5:
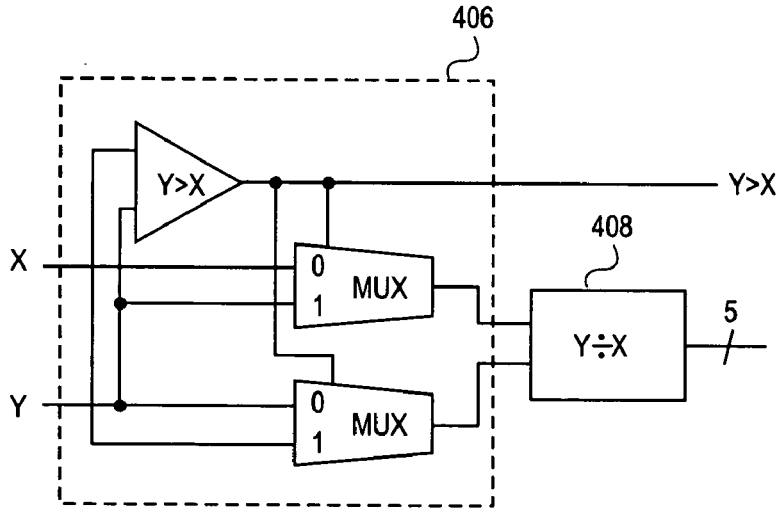
FIG. 5 is a portion of a hue angle calculator.
Figure 6:
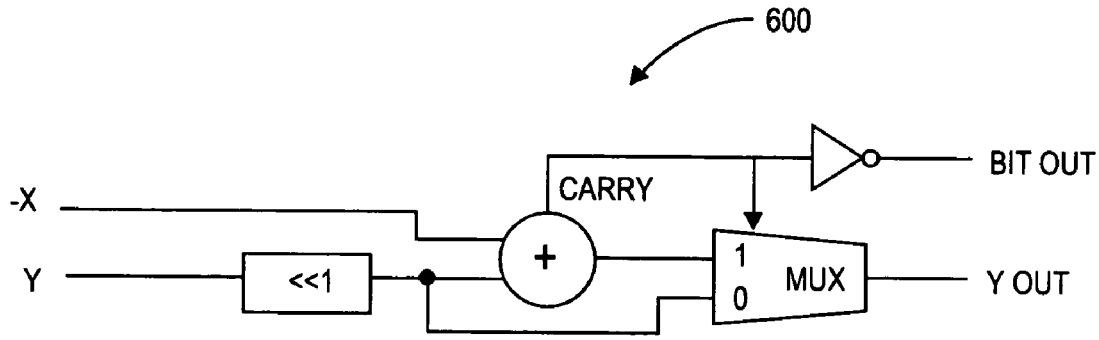
FIG. 6 is one stage of a division unit embodiment.

The test as to whether the chroma y value is greater than the chroma x value may determine whether the hue angle is in the first or second octant of the vector angle or, alternatively, whether the angle is greater than 45 degrees. By swapping the x and y components of chroma (as possibly performed by block 406 in FIGS. 4 and 5), it is possible to limit the calculations to the first octant of all possible color vector angles. Of course, the result of the test may be saved for correcting the final output hue angle. Division module 408 supplies input data to the arctangent look up table, as will be discussed later.

Action LUT

One embodiment of Action LUT 410 may comprise a small table of bits and offsets that are added in the final step to correct for the simplification of doing all the calculations in the first octant. One possible embodiment of the Action LUT is included below. In this example, the concatenation of the y<0 x<0 and y>x results is the address of this LUT. The output is a "neg" bit and an offset. The neg bit indicates if the negative of the arc tangent result is needed. The offset is an angle to add to the upper bits in the final step. It may be desirable to select the units of angle for the hue angle to produce only 256 "degrees" of angle around the color vector circle. This results in several convenient optimizations. One of these is that all the offsets in the Action LUT are multiples of 64 and the lower 6 bits were always zero and these did not need to be stored.

Action LUT

| Address | neg | Offset |
|---|---|---|
| 000 | 0 | 00 |
| 001 | 1 | 01 |
| 010 | 1 | 10 |
| 011 | 0 | 01 |
| 100 | 1 | 00 |
| 101 | 0 | 11 |
| 110 | 0 | 10 |
| 111 | 1 | 11 |

y/x Divide

At block 408, the y component is divided by the x component of chroma. This can be done in many possible ways. One way might be to invert the x component into a fixed point fraction and then do a multiply with y. The inversion could be done in a LUT, however the results of the multiply may be inaccurate unless the multiply is sufficiently wide (e.g. 12 bits). It may be possible to accomplish the divide in a multiple step pipeline, using a module 600 ("DIV1") as shown in F*igure* 6. Each step in the division does a single shift, addition and selection. The output is the remainder for the next step and one bit of the result. After a finite number of steps, all the bits needed from the division will be available.

Figure 7:
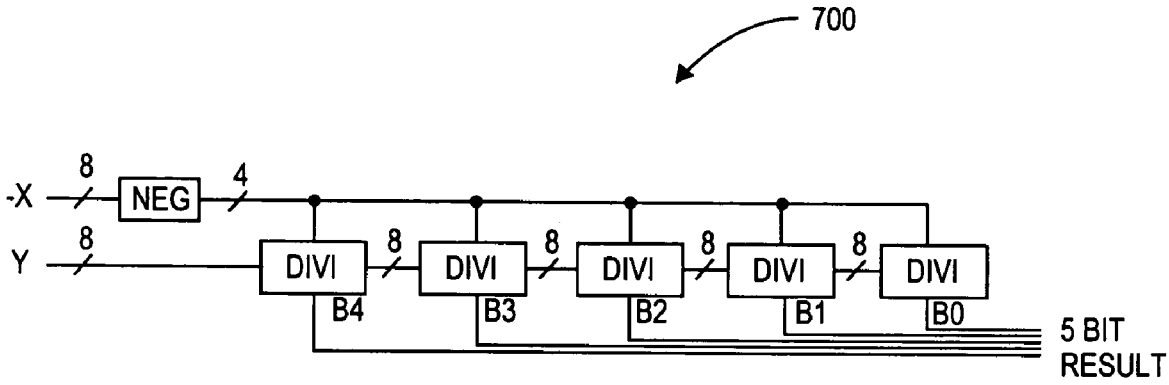
FIG. 7 is one embodiment of a five division units connected to perform a 5-bit divide

FIG. 7 shows one possible embodiment 700 where x and y are 8 bit data units and the result is a 5 bit number. It should be noted that −x may be 9 bits, formed from an 8 bit number that has been negated (twos compliment). When y is left shifted, it also becomes 9 bits for the addition. Only the lower 8 bits of the result may suffice for the Y OUT. Additionally, it might be possible to drop the least significant bit from both x and y, to allow using 8 bit adders in all the DIV1 modules. The carry bit from the addition may be used to select either the input y value or the "subtracted" y value as the output. The inverse of the carry is the result bit.

In FIG. 7, it is noted that the x component of chroma need only be negated (twos compliment) once at the start of the pipeline. It is also notes that the DIV1 module has been optimized for the case when x>y and when the result is a fixed point fraction less than 1. When x=0, the result will be zero. When x=y, the result would be all bits on, which is slightly smaller than the correct answer. However, as storing the correct answer would require another bit in the result, this small error may suffice to be close enough for hue angle calculations to realize some hardware efficiencies.

Arc Tangent LUT

The result of the division may be used as the index to an arc tangent table. One possible embodiment of the arc tangent table is shown below. As this table may be small, it may be possible to store both the positive and negative arc tangent values and use the neg bit from the Action LUT as the least significant bit of the address of the Arc Tangent LUT. In one embodiment in which the original values are 5 bit unsigned integers, their negatives may produce 6 bits to have room for the sign bit. However, the sign bit is typically identical to the input neg bit, so it may not necessary to store it and the table may remain 5 bits wide.

Arc Tangent LUT

| | | | | | | | |
|---|---|---|---|---|---|---|---|
| 00 | 00 | 01 | 31 | 03 | 29 | 04 | 28 |
| 05 | 27 | 06 | 26 | 08 | 24 | 09 | 23 |
| 10 | 22 | 11 | 21 | 12 | 20 | 13 | 19 |
| 15 | 17 | 16 | 16 | 17 | 15 | 18 | 14 |
| 19 | 13 | 20 | 12 | 21 | 11 | 22 | 10 |
| 23 | 09 | 24 | 08 | 25 | 07 | 25 | 07 |
| 26 | 06 | 27 | 05 | 28 | 04 | 29 | 03 |
| 29 | 03 | 30 | 02 | 31 | 01 | 31 | 01 |

Final Addition

The result of the Arc Tangent LUT may be added to the offset selected from the Action LUT. However, this operation may be simpler than a full addition. Because the offset from the Action LUT may have a certain number of (e.g. 6) implied bits of zeros, the lower bits are not involved in the addition. To construct the final hue angle, the number of (e.g. 5) bits output by the Arc Tangent LUT are simply copied into the lower number of (e.g. 5) bits of the hue angle. The neg bit becomes the last (e.g. $6^{th}$) bit of hue angle, and additional (e.g. two) more copies of the neg bit are added to the offset bits from the action table to form the upper (e.g. two) bits of hue. Thus, in this one embodiment, only a two bit addition is necessary. This is shown in the following table.

| | | | | | | | | |
|---|---|---|---|---|---|---|---|---|
| | neg | neg | neg | atan4 | atan3 | atan2 | atan1 | atan0 |
| + | off1 | off0 | | | | | | |
| = | hue7 | hue6 | hue5 | hue4 | hue3 | hue2 | hue1 | hue0 |

Chromaticity Triangle LUT

The hue angle may be used as the index to a table to determine which chromaticity triangle the input color lies in. One embodiment of chromaticity triangle LUT is given below. In the case of RGBW, there may be only three chromaticity triangles, so the table may result in only one of three possible values. The calculations leading up to this look-up may trade-off the need for a larger LUT without such calculations.

| Chromaticity Triangle LUT | | | | | | | | | | | | | | | |
|---|---|---|---|---|---|---|---|---|---|---|---|---|---|---|---|
| 2 | 2 | 2 | 2 | 2 | 2 | 2 | 2 | 2 | 2 | 2 | 2 | 2 | 2 | 2 | 2 |
| 2 | 2 | 2 | 2 | 2 | 2 | 2 | 2 | 2 | 2 | 2 | 2 | 2 | 2 | 2 | 2 |
| 2 | 2 | 2 | 2 | 2 | 2 | 2 | 2 | 2 | 2 | 2 | 2 | 2 | 2 | 2 | 2 |
| 2 | 2 | 2 | 2 | 2 | 2 | 2 | 2 | 2 | 2 | 2 | 2 | 2 | 2 | 2 | 2 |
| 2 | 2 | 2 | 2 | 2 | 2 | 2 | 2 | 2 | 2 | 2 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 2 | 2 | 2 | 2 |

Multi-Primary Matrix LUT

The chromaticity triangle number may, in turn, be used to select one of the multi-primary matrices, stored in LUT 110 in FIG. 1, to be used in a color-space conversion step later. These numbers may change according to the characteristics of any given, different, display model—one embodiment of which is shown below. It should be noted that the conversion matrices may involve positive and negative numbers, so the multipliers may be signed—unless optimizations suggested herein are used. In one embodiment, the values in these matrices may be multiplied by 128 to allow room for 7 bits of value plus a sign bit. Thus, the results may be divided by 128 instead of 256.

| Multi-Primary Matrices | | | | | | | | |
|---|---|---|---|---|---|---|---|---|
| 168 | 0 | −40 | 128 | 0 | 0 | 168 | −40 | 0 |
| 0 | 168 | −40 | −40 | 168 | 0 | 0 | 128 | 0 |
| 0 | 0 | 128 | −40 | 0 | 168 | 0 | −40 | 168 |
| RGW, triangle 0 | | | GBW, triangle 1 | | | BRW, triangle 2 | | |

RGB Color Path

Input Gamma LUT

In one embodiment, incoming data to the pipeline could be "sRGB", or nonlinear RGB. In such a case, it may be desirable to linearized this data in an (optional) input gamma table (as shown as block 103 in FIG. 1) before performing color conversions or sub-pixel rendering. It should be noted that the hue angle may be calculated from the sRGB values, since the color conversion should preserve hue angle. This allows hue angle to be calculated with the nonlinear RGB values. One aspect of sRGB is that it acts somewhat as a compression scheme that allows image data to be stored in 8 bits when it might normally require more. So, once the data is linearized, it may be desirable to store the resulting data in more bits to avoid any possible image defects. Thus, in the embodiment shown in FIG. 1, input gamma block 103 converts the 8 bit input data to 11 bit linear RGB data.

If the input data turns out to be YCbCr or some other TV format, most of these also have an implied nonlinear transformation applied to them and may also require an input gamma table. For these formats, it may be desirable to convert into sRGB before sending it down the pipeline.

Multi-Primary Matrix Multiply Conversion

In one embodiment, it is possible to perform a 3×4 matrix multiply in order to effect RGB to RGBW color-space conversion. This might require 12 multipliers and adders. However, in RGBW, the W value may turn out to be equal to one of the other results, reducing the matrix multiply down to 3×3. In one embodiment, this may still be problematical to implement since each multiply is 11×8=12 bits with the 8 bit coefficient signed as well. It should be noted that the multipliers input 11 bit values but output 12 bit results. This extra bit may be used to detect out-of-gamut values in the gamut clamping path described below.

Figure 8:
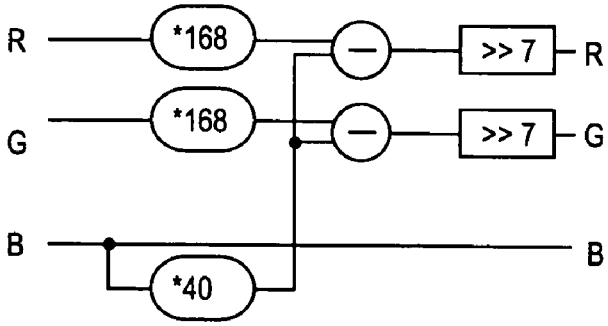
FIG. 8 is RG case of a 3×3 matrix multiplier simplified embodiment.
Figure 9:
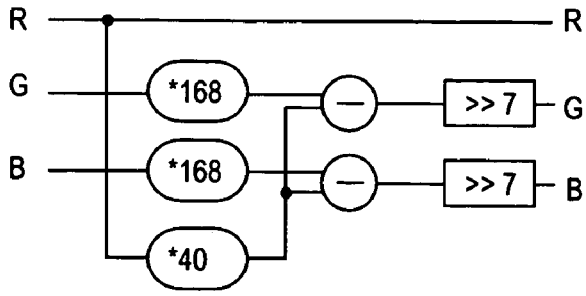
FIG. 9 is the GB case of a 3×3 matrix multiplier simplified embodiment.
Figure 10:
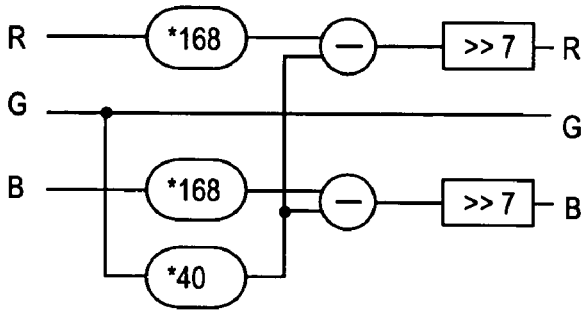
FIG. 10 is the BR case of a 3×3 matrix multiplier simplified embodiment.

Advantageously, many of the coefficients in the matrices are either zero or powers of two. Of the remaining coefficients, multiplying by 168 can be done with three shifts and adds while 40 can be done by two shifts and adds. To take advantage of these constants, special purpose hardware can be designed for each chromaticity triangle. Fortunately, in RGBW, there are only three triangles so the hardware to do all the cases may remain simple. It is possible that all three formula will run in parallel with a MUX at the end to select the correct answer based on the chromaticity triangle number output by the hue angle path. FIGS. 8, 9 and 10 are embodiments that implement the calculation for the RGW, GBW and the BRW chromaticity triangles, respectively. Thus, in these embodiments, multiplying the 11 bit input numbers by the 8 bit constants will result in 19 bit numbers. When these are right shifted by 7, the final result will be a 12 bit number. The upper bit on these values indicates that the color is out-of-gamut and is used by the gamut clamping path described later. It is also possible to generate negative results here, and these must be clamped to zero.

It should also be noted that each input color is multiplied by 168 in two of the three triangle cases. This calculation could be shared between the formula, only multiplying by 168 a total of three times, further reducing the total number of gates. It should also be noted that the exact constants used may change when the chromaticity of each new RGBW display model is measured.

Gamut Clamping Path

When black and white are mapped to the same colors in RGB and RGBW, the total gamut "volume" of RGBW may turn out to be smaller than RGB. Thus, there may be some colors, especially bright saturated ones, that exist in RGB but cannot be displayed in RGBW. When these colors appear, it may be desirable to manage this situation. Simply clamping the RGBW values to the maximum range may result in the hue of these colors being distorted. Instead the out-of-gamut colors could be detected and scaled in a way that preserves hue while bringing them back into range.

Detecting In-Gamut

Figure 11:
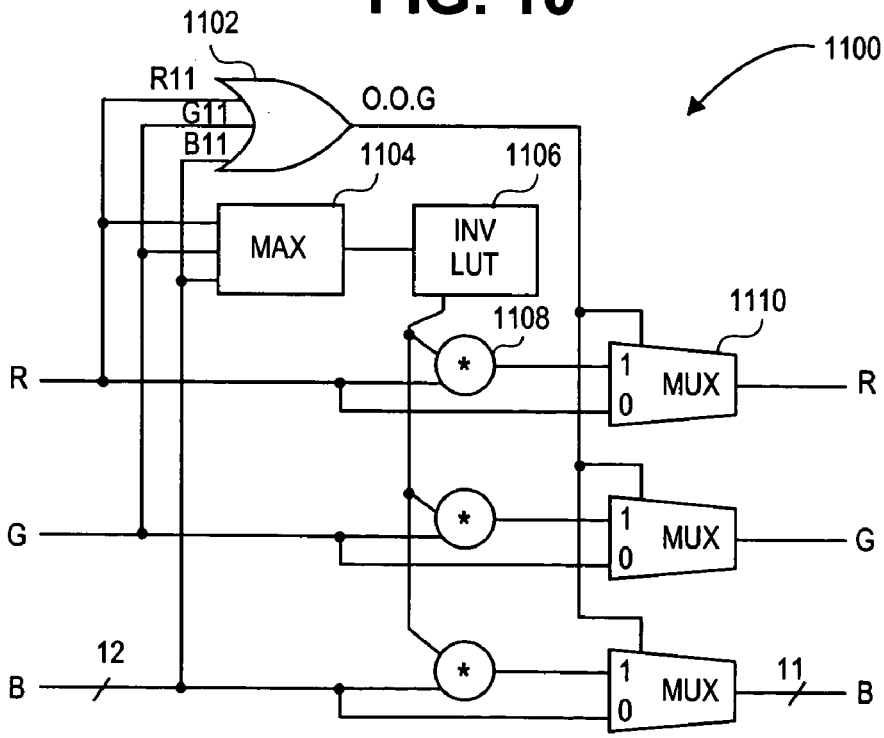
FIG. 11 is one embodiment of a gamut clamping circuit.

The multipliers and accumulators in the multi-primary matrix conversion section above may be designed to return values larger than their input values. This is to allow out-of-gamut (O.O.G.) values to be calculated. These values are typically not more than twice the range of the input values, so one more bit may be allowed in the output for "overflow" values. If this extra overflow bit is zero in all three of the R G and B results, then the color is in gamut and it could be gated around the rest of the gamut clamping path. FIG. 11 shows one embodiment of hardware that could effect the functionality of blocks 114 and/or 116 in FIG. 1. As may be seen, the upper bit (bit 11) of all three converted primaries are OR'ed (1102) together to produce the O.O.G. signal—which can then be used by multiplexors 1110 to select a bypass mode or data modified by the Inv LUT 1106.

Out-of-Gamut Response

If the overflow bit in any one of the R G and B results is on, this indicates that an out-of-gamut color has resulted and all three of the primaries may be scaled by some factor—e.g. the same factor. Scaling all three components by the same factor may tend to decrease luminosity and saturation but preserve hue. This scale factor typically is a number slightly less than one, so it may be a fixed point binary fraction.

Maximum Component

One manner of handling out of gamut data is to calculate the ratio of distance to the edge of the gamut relative to the out-of-gamut distance as the gamut scaling factor to bring out-of-gamut values back in range. In one mode of calculation, this might require calculating two square roots. In another embodiment, the ratio of the width of the color-space relative to the maximum component of the out-of-gamut color may yield the same result—without need of costly square root calculations. This may be seen by looking at similar triangles within the gamut. The width of the color-space tends to be a power of two (e.g. $2^{11}$ for the case of 11 bit linear RGB values) and becomes a convenient bit shift. MAX block 1104 selects the maximum component of the out-of-gamut color.

Inverse LUT

The maximum out-of-gamut component is inverted by looking it up in an inverse LUT 1106. In one embodiment, although using 12 bit converted values will allow 2-times out of gamut values, in practice, it may be rare that it will be more than 25% above the maximum allowed value. This allows the Inverse LUT to have only 256 entries. The lower 8 bits of the maximum out-of-gamut component may be used as an index into this table. A table of inverses may contain some errors, but the first 25% of the l/x table is typically not where the errors occur, so this may suffice.

Clamping Multipliers

In one embodiment, the Inverse LUT may have 12 bit values in it, so three 12×11=11 multipliers may suffice to scale out-of-gamut values back down into range. The output of the multipliers may only be 11 bits because the inverse numbers could be expressed as fixed point binary numbers between 0.75 and 1. It is also possible that the inverse table could be a little narrower, perhaps only 8 bits per inverse value, resulting in significant savings in gates by using a 12×8=11 multiplier.

When the R G and B components output from the multi-primary matrix multiply are out-of-gamut, they may be multiplied by the output of the Inverse LUT. When the value is in gamut, the input values may be gated around the multipliers, thus bypassing the gamut clamping.

White Selection

Figure 12:
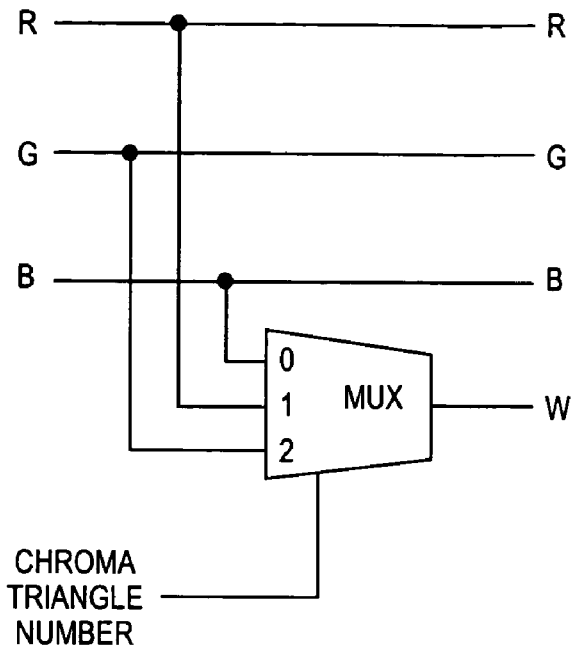
FIG. 12 is one embodiment of a W selector.

As mentioned above, the W value of RGBW may turn out to be equal to one of the other primaries, so selecting W may be delayed until later to avoid duplicate processing. FIG. 12 shows one embodiment of hardware that selects the W value from one of the other converted primaries with a MUX. The result will be 4 primaries, RGB and W and this concludes the RGB to RGBW multi-primary conversion. It should be noted that the W value is equal to one of the other primaries up to this stage, but since the Sub-Pixel Rendering treats W different than the other primaries, the final results to the display will be a W value different than any of the other primaries.

Sub-Pixel Rendering and Output Gamma

In one embodiment, the output from multi-primary conversion may be linear color components so the sub-pixel rendering module will not have to perform input gamma conversion. This also means that the input components may have more than 8 bits per primary (e.g. 11 bits in one embodiment). In the embodiment of FIG. 1, there is shown output gamma being performed after the sub-pixel rendering to show that the data can stay in the linear domain until the last moment before being converted to send to the display. It should be appreciated that such an output gamma table may be tailored for the particular display panel.

Optional Output Gamma LUT

In other embodiments, it is possible that the RGBW display may employ more than one step on more than one board. Thus, between boards, it may be desirable to transmit the data on standard interfaces with 8 bit values. As mentioned above, truncating the linear components to 8 bits is not preferred. One manner to compensate is to convert the data for transmission by applying the sRGB non-linear transformation to the data on the way out. Then, the second board can perform input gamma correction to linearize the data again to 11 bits.

Figure 13:
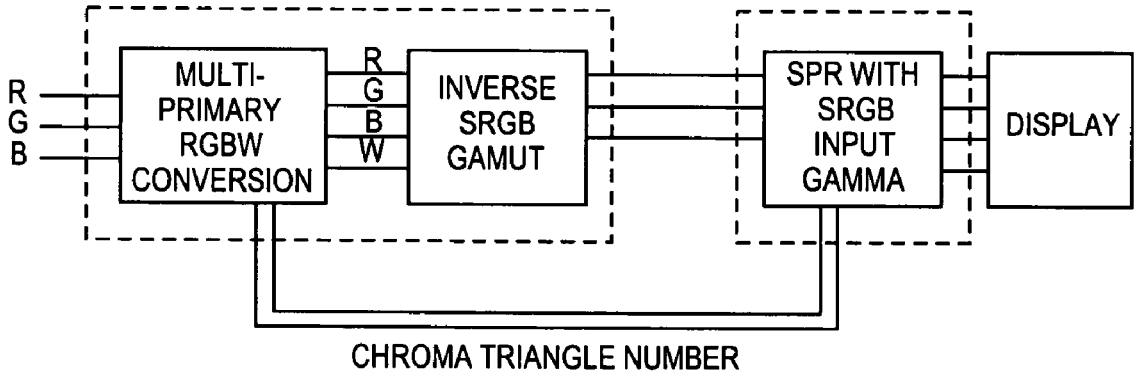
FIG. 13 is one embodiment of a diagram showing reduced bandwidth by delaying the W selection.

It may also be difficult to send 4-primary colors between the boards. FIG. 13 depicts one embodiment. The system sends two bits of information along with three (RGB) primary colors, the W selection MUX can be moved onto the second board and the W primary will not have to be transmitted between boards. The two bits of information sent would be the chromaticity triangle number calculated on the hue angle path.

RGBW Simplified for Low Cost Implementations

The complexity of doing multi-primary conversions seems to have confined RGBW to used only in high-end systems. However, there may be ways to use the multi-primary conversions for RGBW in low cost displays. The few remaining multiplies by odd constants may be done in software in some implementations, or perhaps it is suffices to convert those constants into numbers that are easier to implement in hardware.

When the primaries and white point are identical to the sRGB standard, the matrices become even simpler. The sRGB primaries and white point results in numbers that can be multiplied with only 2 or 3 shifts and adds as shown above and in FIGS. 8, 9 and 10. The limiting factor may be the complexity of the SPR algorithms.

| | Red | Green | Blue | White Point |
|---|---|---|---|---|
| x | 0.6400 | 0.3000 | 0.1500 | 0.3127 |
| y | 0.3300 | 0.6000 | 0.0600 | 0.3290 |
| z | 0.0300 | 0.1000 | 0.7900 | 0.3583 |

The above table has the CIE Chromaticity values for the sRGB standard. Using these values the CIE XYZ coordinates of the D65 white point can be calculated and the conversion matrix for converting linear RGB values into CIE XYZ tristimulus values can be derived:

$$D65 = \begin{pmatrix} 0.950456 \\ 1 \\ 1.089058 \end{pmatrix}. \quad R2X = \begin{pmatrix} 0.412391 & 0.357584 & 0.180481 \\ 0.212639 & 0.715169 & 0.072192 \\ 0.019331 & 0.119195 & 0.950532 \end{pmatrix}.$$

Additionally, one possible matrix that converts RGBW values into CIE XYZ tristimulus values using the above primaries is as follows:

$$W2X = \begin{pmatrix} 0.314179 & 0.272425 & 0.137499 & 0.226353 \\ 0.161998 & 0.54485 & 0.055 & 0.238153 \\ 0.014727 & 0.090808 & 0.724161 & 0.259362 \end{pmatrix}.$$

The matrices that convert CIE XYZ tristimulus values into RGBW values are given below as:

$$Mrg = \begin{pmatrix} 4.236707 & -1.954206 & -0.984886 \\ -1.289617 & 2.526155 & -0.275862 \\ 0.05563 & -0.203977 & 1.056972 \\ 0.05563 & -0.203977 & 1.056972 \end{pmatrix}.$$

$$Mgb = \begin{pmatrix} 3.24097 & -1.537383 & -0.498611 \\ -2.285349 & 2.942975 & 0.21041 \\ -0.940103 & 0.212844 & 1.543245 \\ 3.24097 & -1.537383 & -0.498611 \end{pmatrix}.$$

$$Mbr = \begin{pmatrix} 4.557083 & -2.604397 & -0.667467 \\ -0.969244 & 1.875968 & 0.041555 \\ 0.376004 & -0.854165 & 1.374389 \\ -0.969244 & 1.875968 & 0.041555 \end{pmatrix}.$$

An input color would be converted using one of these three matrices, depending on which chromaticity triangle it lies in. These coefficients may be derived using the standard sRGB chromaticities. Using the same primaries for the input data and the display simplify these matrices.

When the color primary assumptions of an input image are not known, sRGB assumptions may be used. Input RGB values would be converted to CIE XYZ by using the R2X matrix mentioned earlier, then converted to RGBW using one of the three matrices above. In practice, the R2X matrix can be combined with each of the other three matrices beforehand so that only one matrix multiply suffices for each input color. Also in a low cost implementation the matrices are converted to integers by multiplying them by some power of two:

$$MRG := Mrg \cdot R2X \cdot 64$$

$$MRG = \begin{pmatrix} 84 & 0 & -20 \\ 0 & 84 & -20 \\ 0 & 0 & 64 \\ 0 & 0 & 64 \end{pmatrix}.$$

-continued $$MGB := Mgb \cdot R2X \cdot 64$$

$$MGB = \begin{pmatrix} 64 & 0 & 0 \\ -20 & 84 & 0 \\ -20 & 0 & 84 \\ 64 & 0 & 0 \end{pmatrix}.$$

$$MBR := Mbr \cdot R2X \cdot 64$$

$$MBR = \begin{pmatrix} 84 & -20 & 0 \\ 0 & 64 & 0 \\ 0 & -20 & 84 \\ 0 & 64 & 0 \end{pmatrix}.$$

In the above example, the matrices are combined then multiplied by 64 to convert their coefficients into fixed point binary numbers with 6 bits below the binary point. Other powers of two will work, depending on the precision required and the hardware available. Using a value of 64 in this case results in coefficients that will fit in 8 bit bytes with a sign bit. This results in low-cost implementations where only 8 bit arithmetic can be done. In implementations with 16 bit arithmetic a larger multiplier than 64 could be used.

These matrices involve multiplying by 0, by 64 (which is multiplying by one after the fixed point binary shift), by 84 and by 20. Multiplying by 20 can be done with two shifts and an add, multiplying by 84 can be done by three shifts and two adds. Two subtracts are always required after the multiplies. This is simple enough to implement in hardware or software so it is not necessary to try and find more convenient numbers.

Figure 14:
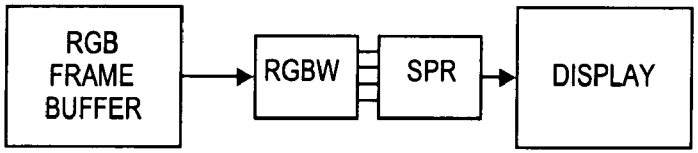
FIG. 14 is one embodiment of a diagram showing RGBW conversion and SPR in hardware.

The conversion from sRGB to RGBW can be done in hardware fairly inexpensively. Sub-pixel rendering may require line buffers and filters running at display refresh rates. If a system has hardware SPR, the addition of logic to do RGBW is not appreciably more difficult. In the hardware model, all the RGB values are fetched once for every frame time, converted to RGBW, shifted through line buffers, area resample filtered, sent to the TCON and/or display and forgotten. This system is depicted in FIG. 14.

Figure 15:
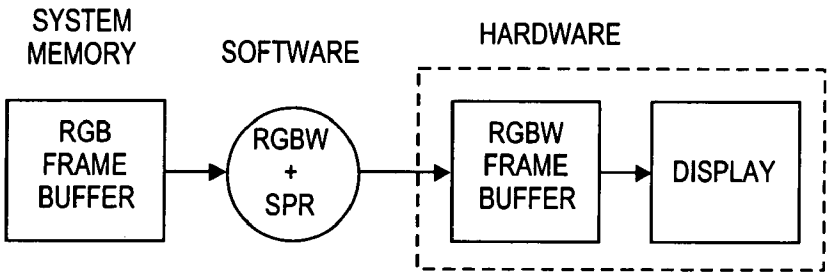
FIG. 15 is one embodiment of a diagram showing a software implementation of RGBW and SPR with simplified display hardware.

However, in one embodiment of a low cost implementation, SPR may be done in software, as opposed to hardware. Thus, it is reasonable to add RGBW calculations in software as well. In one embodiment, there may be some frame buffers to access. For example, if there is a RGB frame buffer in system memory that application programs write to, then a software driver may convert this data to the sub-pixel rendered version and store it in a hardware frame buffer. Such a system is depicted in FIG. 15. Optionally, the system could have the driver convert small rectangular areas that have changed, and not require that the entire display be reconverted every time any change is made.

Often, the software driver may not completely simulate the hardware. For example the software may not have line buffers but does random-access reads to the RGB frame buffer instead. This might require recalculating RGBW values from the RGB values every time they are fetched. For example, in one embodiment, the SPR filters could be 2×3 coefficients. Thus, in this case, each RGB value might be fetched and converted 6 times in the course of re-rendering the area around it.

In one embodiment, determining the chromaticity triangle number could be reduced to 4 compares. Matrix multiply can be done with 5 shifts, three adds and two subtracts. Gamut clamping may require two compares and three divides. Gamut clamping may be done on a small subset of colors and a simple set of 3 tests determines if this step can be skipped.

If the processor is fast enough and can do the divisions (or at least, inverse table lookup and multiply) then this may suffice.

Figure 16:
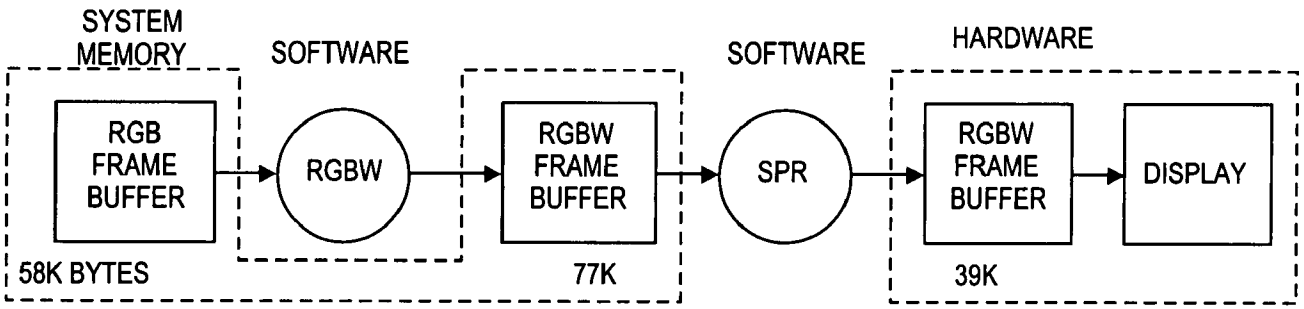
FIG. 16 is an alternate embodiment of a software implementation of RGBW and SPR

However, on a slower processor, with sufficient memory to store another copy of the frame buffer, the time spent converting to RGBW may be reduced by converting every RGB pixel to RGBW only once and storing them in an intermediate frame buffer. For one example, consider a 120×160 by 24 bit RGB display. Storing a copy of the RGB frame buffer may take only 58 Kbytes. The RGBW intermediate frame buffer would be 77 Kbytes. After SPR the hardware frame buffer would only be 39 Kbytes. Such a system is depicted in FIG. 16.

One additional embodiment might replace the RGBW frame buffer with smaller line buffers. With more software processing, it is possible to build line-buffers of RGBW values similar to the line buffers in typical SPR hardware implementations. Two line buffers the width of the display might suffice. In this version, the RGB values are only fetched and converted once, then read multiple times out of the line buffers.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A computer-readable medium having computer-executable instructions for calculating the luminance value from an input image data, said input image data comprising a red (R) digital data value, a green (G) digital data value and a blue (B) digital data value, said luminance value calculation comprising:

shifting said R digital data value to the left by one digital place value, producing a R intermediate digital data value;

shifting said G digital data value to the left by two digital place values, producing a G intermediate digital data value;

adding said R intermediate digital data value to said B digital value, producing a first intermediate value;

adding G digital value to said G intermediate digital data value, producing a second intermediate value;

adding said first intermediate value to said second intermediate value, producing a third intermediate value; and shifting said third intermediate value by three digital place values, producing said luminance value.

2. The computer-readable medium of claim 1 wherein said luminance value calculation further comprises performing the calculation Y=(2*R+5*G+B)/8, where Y is substantially the luminance value for said input image data.

3. A computer-readable medium having computer-executable instructions for calculating the hue angle of an input image data, said input image data comprising a red (R) digital data value, a green (G) digital data value and a blue (B) digital data value, said hue angle calculation comprising:

calculating a luminance value from said input image data, producing a Y digital value;

calculating intermediate values x=absolute values of B−Y and y=absolute value of R−Y;

swapping intermediate values x and y if y>x;

dividing y by x;

accessing an action look-up table to provide correction bits for performing calculations within the first subset of hue angle space; and accessing an arctangent look-up table, said arctangent table producing an intermediate hue angle value.

4. The computer-readable medium of claim 3 wherein said calculating of a luminance value comprises performing the calculation Y=(2*R+5*G+B)/8, where Y is substantially the luminance value for said input image data.

5. The computer-readable medium of claim 3 wherein said calculating of a luminance value comprises:

shifting said R digital data value to the left by one digital place value, producing a R intermediate digital data value;

shifting said G digital data value to the left by two digital place values, producing a G intermediate digital data value;

adding said R intermediate digital data value to said B digital value, producing a first intermediate value;

adding G digital value to said G intermediate digital data value, producing a second intermediate value;

adding said first intermediate value to said second intermediate value, producing a third intermediate value; and shifting said third intermediate value by three digital place values, producing said luminance value.

6. The computer-readable medium of claim 3 wherein said action look-up table provides corrections with the first octant of said hue angle space.

7. A computer-readable medium having computer-executable instructions for converting an RGB input image data into an RGBW image data, said conversion comprising:

calculating the hue angle of said RGB input image data;

selecting the chromaticity triangle of said RGB input image data based upon said hue angle, said chromaticity triangles being selected from one of a group, said group comprising RGW, GBW and BRW;

selecting a multi-primary matrix based upon said chromaticity triangle;

multiplying said multi-primary matrix to said RGB input image data to produce an intermediate RGBW image data value; and wherein further said multi-primary matrix being selected from one of a group, said group comprising:

$$\begin{matrix} 168 & 0 & -40 \\ 0 & 168 & -40 \\ 0 & 0 & 128; \end{matrix} \quad \begin{matrix} 128 & 0 & 0 \\ -40 & 168 & 0 \\ -40 & 0 & 168; \end{matrix} \text{ and } \begin{matrix} 168 & -40 & 0 \\ 0 & 128 & 0 \\ 0 & -40 & 168. \end{matrix}$$

8. The computer-readable medium of claim 7 wherein said group of said multi-primary matrices correspond to RGW, GBW, and BRW chromaticity triangles respectively.

9. The computer-readable medium of claim 7 wherein the conversion further comprises:

detecting out-of-gamut image data values;

determining the maximum color component that is out-of-gamut; and accessing an inverse look-up table for providing a scaling factor to apply to said out-of-gamut image values.

10. The computer-readable medium of claim 7, wherein the conversion further comprises:

subpixel rendering said RGBW image data values; and accessing an output gamma look-up table for providing gamma values to be applied to image data values from said subpixel rendering module.

* * * * *